US005765732A

United States Patent [19]

Brandt

[11] Patent Number: 5,765,732

[45] Date of Patent: Jun. 16, 1998

[54] BELT SUPPORTED GUN REST

[76] Inventor: Darrell Wayne Brandt, HCR 33, Box 285, Elkins, Ak. 72727

[21] Appl. No.: 626,059

[22] Filed: Apr. 1, 1996

[51] Int. Cl.[6] ..... A45F 5/00; F41C 33/02

[52] U.S. Cl. ..... 224/149; 224/270; 224/913

[58] Field of Search ..... 224/913, 149, 224/268, 200, 192, 911, 912, 193, 270

[56] References Cited

U.S. PATENT DOCUMENTS

| | | | |
|---|---|---|---|
| 2,588,467 | 3/1952 | Barney | 224/913 |
| 3,081,923 | 3/1963 | Bagby | 224/913 |
| 3,127,075 | 3/1964 | Yavello | 224/913 |
| 4,285,068 | 8/1981 | Rose | 2/202 |
| 4,433,500 | 2/1984 | Kunevicious | 42/1 N |
| 4,656,065 | 4/1987 | Yacovella | 428/17 |
| 4,911,345 | 3/1990 | James et al. | 224/149 |
| 5,029,741 | 7/1991 | Easter | 224/149 |

*Primary Examiner*—Henry J. Recla
*Assistant Examiner*—Timothy L. Maust
*Attorney, Agent, or Firm*—Head, Johnson & Kachigian

[57] ABSTRACT

This article is a rest for the butt stock of a rifle or shot gun. It mounts to the belt from a loop at one end of the article. The article supports a weapon in a substantially upright non-firing position. When hunting a person can easily hold the weapon with one hand in near aiming position. It is very flexible, lightweight, and compact for easy storage in small places.

7 Claims, 6 Drawing Sheets

BELT SUPPORTED GUN REST

RELATED U.S. APPLICATION DATA

Not Applicable

BACKGROUND OF THE INVENTION

Prior Art

U.S. Pat. No. 3,422,497 January 1969 224/258
U.S. Pat. No. 3,700,147 October 1972 224/149
U.S. Pat. No. 4,165,826 August 1979 224/911
U.S. Pat. No. 4,544,098 October 1985 224/253
U.S. Pat. No. 4,787,540 November 1988 224/193
U.S. Pat. No. 4,911,345 March 1990 224/149
U.S. Pat. No. 5,029,741 July 1991 224/149

SUMMARY OF THE INVENTION

The article is a rest to suspend a weapon from the waist. It is made of camouflage material, and nylon thread which is soft, and will not damage the stock of a weapon. A person can easily hold the weapon with one hand while the belt supports the weight.

DETAILED DESCRIPTION

Figure 4:
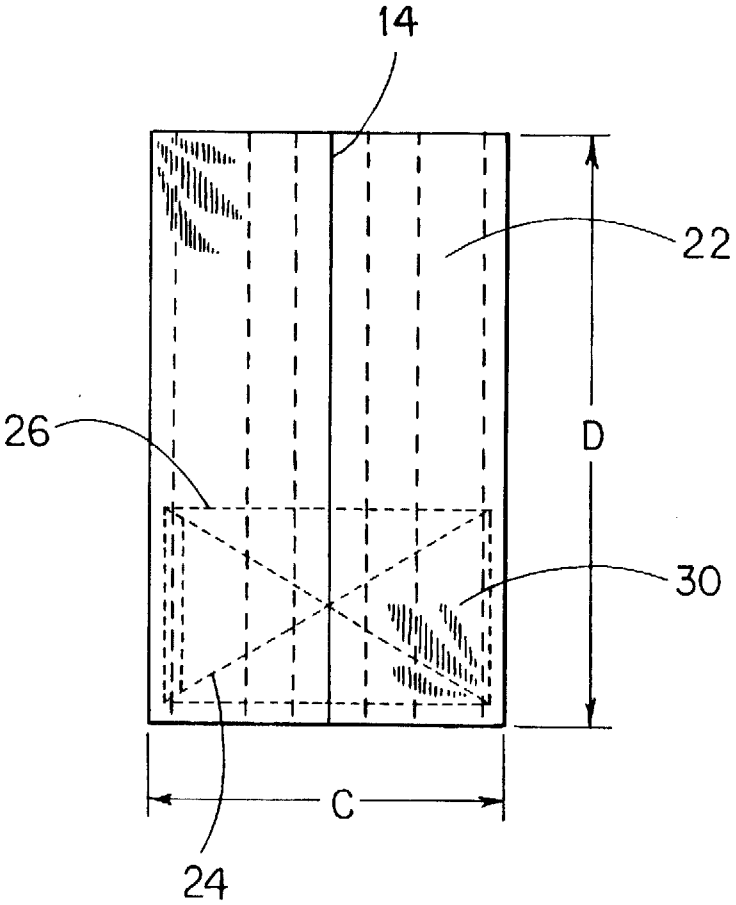
FIG. 4) Is a view of the end which the belt loop is on. It also shows overall height of the belt loop end and width.

The article 10 is made of camouflage material which is 100% cotton, and sewn with nylon thread. The first piece 12 of material is cut in a rectangular shape. Then is folded so that the camouflage pattern is on the inside. Sew along the open side, and invert the material so the camouflage pattern shows on the outside. Place the seam 14 in the center on one side of the flattened material, and sew along each side of the seam, then sew along each outside edge of the material, and then between the two stitchings on each side of the seam. This should provide a stitching pattern as shown in FIG. 4. Sewing the material in this way will hold it flat, and reinforce it to make it stronger and more durable.

Figure 1:
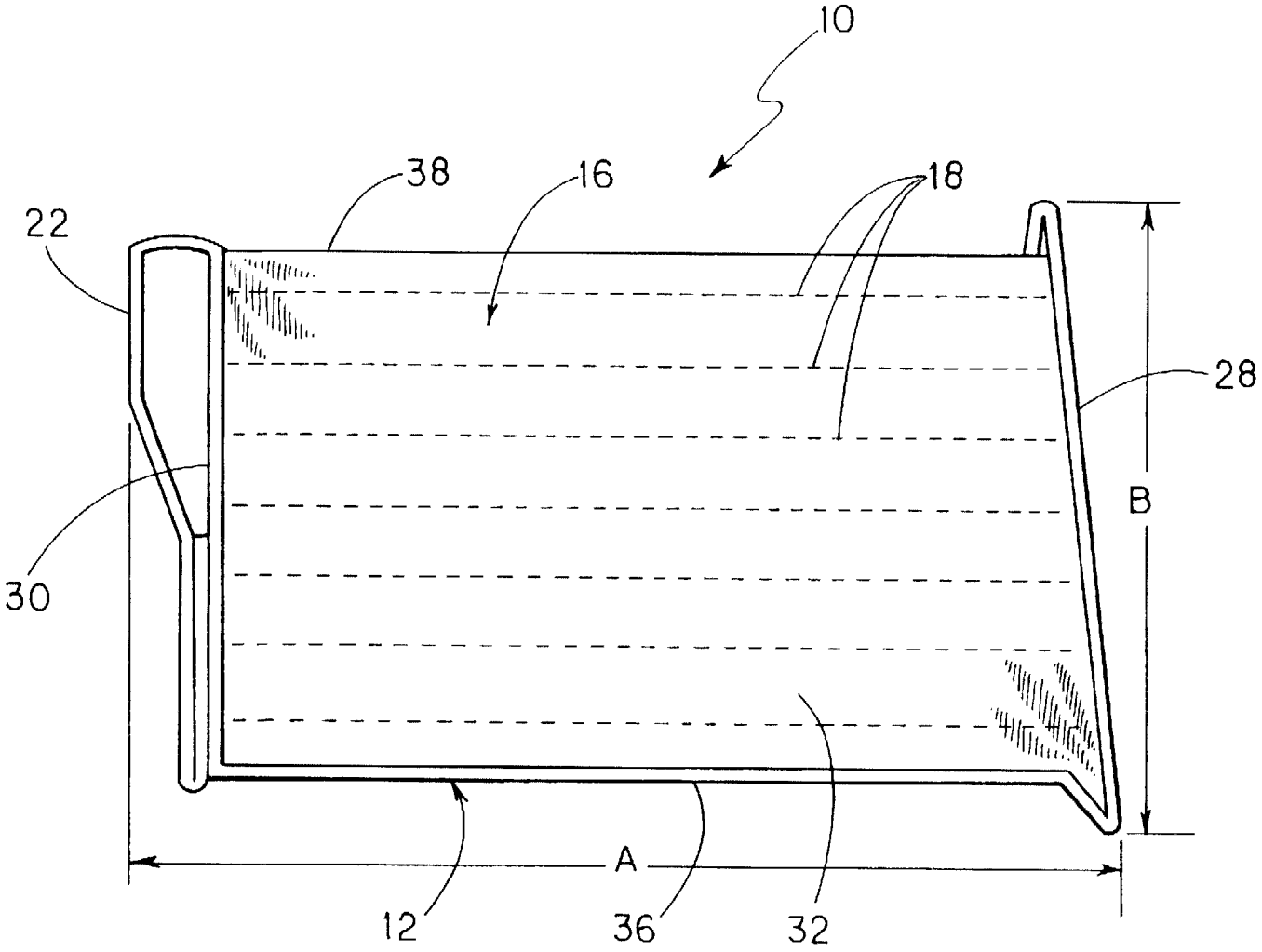
FIG. 1) Is a view of the right side of the gun rest if mounted by the belt loop at one end. It also shows overall length and height.

The second piece 16 of material is also cut in a rectangular shape, but shorter, and wider. The material is then folded so the camouflage pattern is on the inside. Then sew along the open side, and invert the material so the camouflage pattern shows on the outside. Place the seam in the center on one side of the flattened material, and sew along each side of the seam, then sew along each outside edge of the material, then sew between the stitching on each side of the seam, and outside edge placing two stitchings equally apart giving eight stitchings 18 in total. This should provide a stitching pattern as shown in FIG. 1, minus one stitching that is not shown for being sewn over at the bottom edge.

Take this piece of material 16, lay it flat and measure 25 mm from each end on one side, cutting at an angle to the opposite side. This should provide a piece of material 16 with an angle at each end, one side being 50 mm longer than the other. Take this piece of material 16 measuring 23 mm from the ends on the longer side and mark. Being sure that the seam is on bottom, measure 117 mm from these and mark. Take the longer piece of material 12 placing the seam 14 down, measure 170 mm from one end, and mark on both sides of the material.

Figure 3:
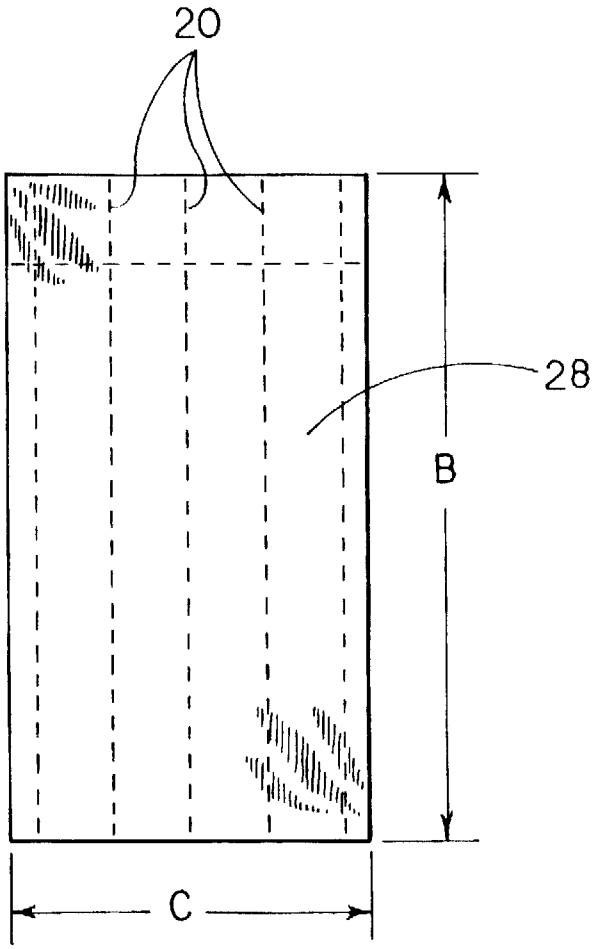
FIG. 3) Is a view of the front of the gun rest if mounted by the belt loop at one end. It also shows overall height of the end opposite the belt loop and width.

Overlap shorter piece of material 16 with the longer piece 12 aligning the marks. Overlapping the edges no more than 5 mm, sew the distance between the 117 mm mark, fold over and sew the other side. Turn over and sew the angling edges centering them. Fold over remaining end and sew reinforcing stitches 20 as shown in FIG. 3.

Figure 2:
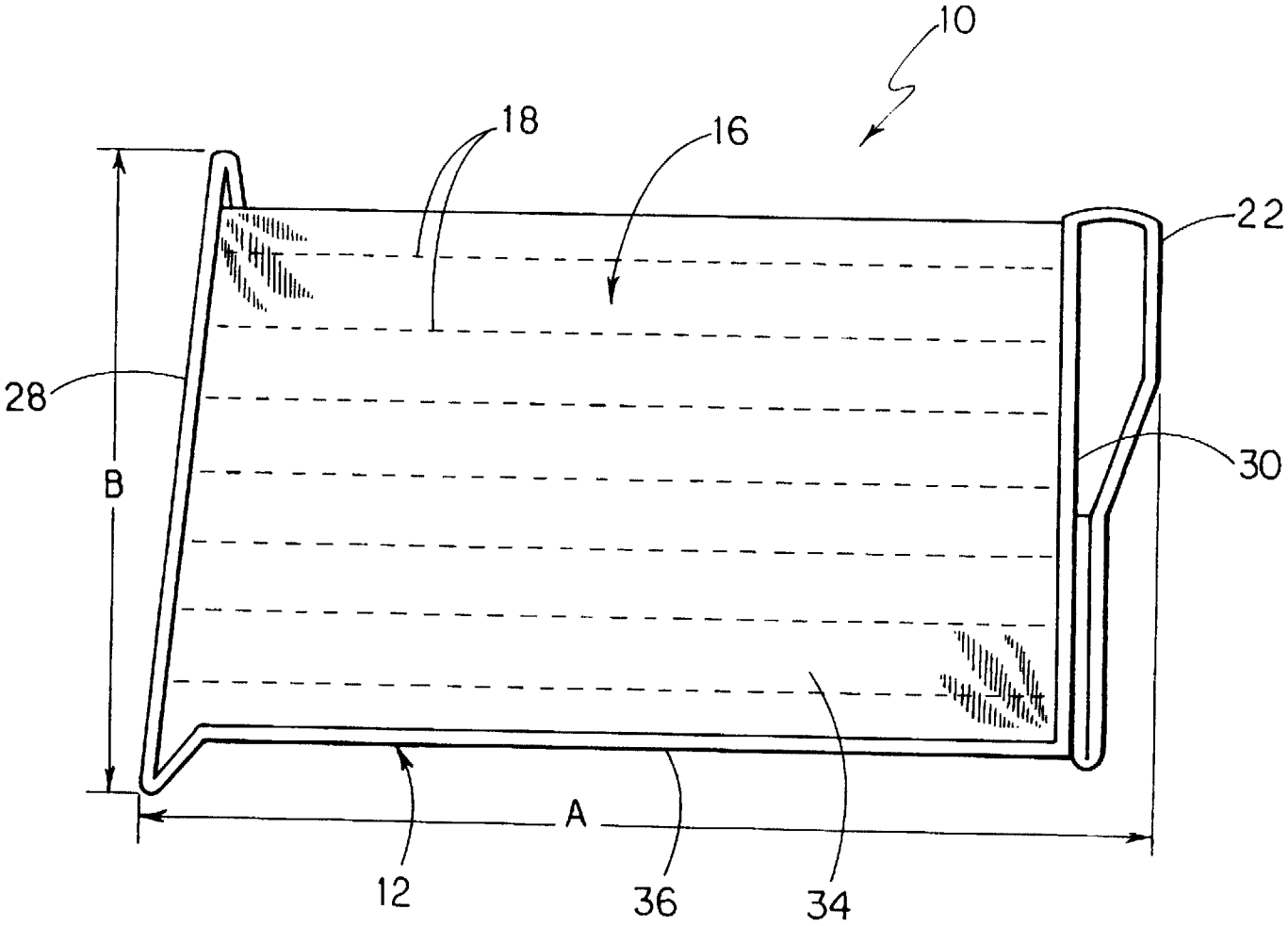
FIG. 2) Is a view of the left side of the gun rest if mounted by the belt loop at one end. It also shows overall length and height.

Change to opposite end sewing to reinforce this end. Fold this end over sewing enough to fold under leaving a loop 22 for a belt as shown in FIG. 1 and 2. At the bottom sew a reinforcing X pattern 24, and then a square 26 around that for extra reinforcement as shown in FIG. 4. Move back to other end, and sew reinforcing stitches on the bottom corners of FIG. 3.

The finished article comprises a front 28, a back 30 with belt loop 22 formed thereon, a right side 32, a left side 34, and a bottom 36. Front 28, back 30, right side 32, left side 34, and bottom 36 form receptacle 38.

In the preferred embodiment, the dimensions of the finished gun rest are as follows:

Dimension A, or length, from outside of loop 22 to bottom of front surface 28, as shown in FIGS. 1 and 2, is 140 mm.

Dimension B, or height of front surface 28, as shown in FIGS. 1–3, is 85 mm.

Figure 6:
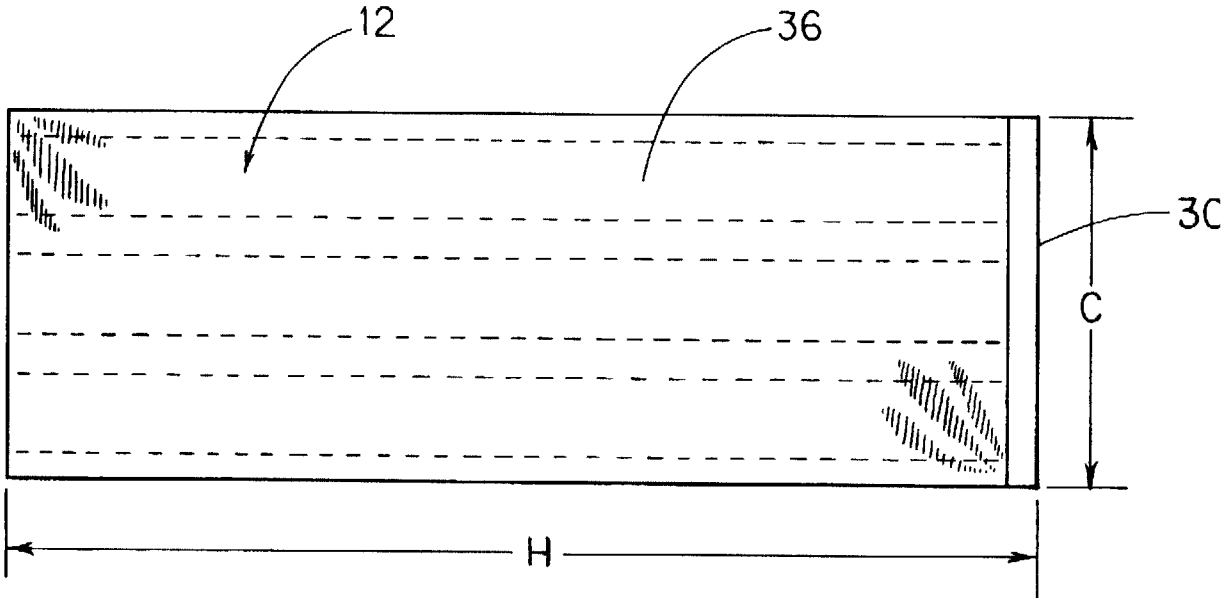
FIG. 6) Is a view of the gun rest if looking at the bottom. It also shows overall length and width.

Dimension C, or width, as shown in FIGS. 3, 4, and 6, is 47 mm.

Dimension D, or height of back surface 30, as shown n FIG. 4, is 75 mm.

Figure 5:
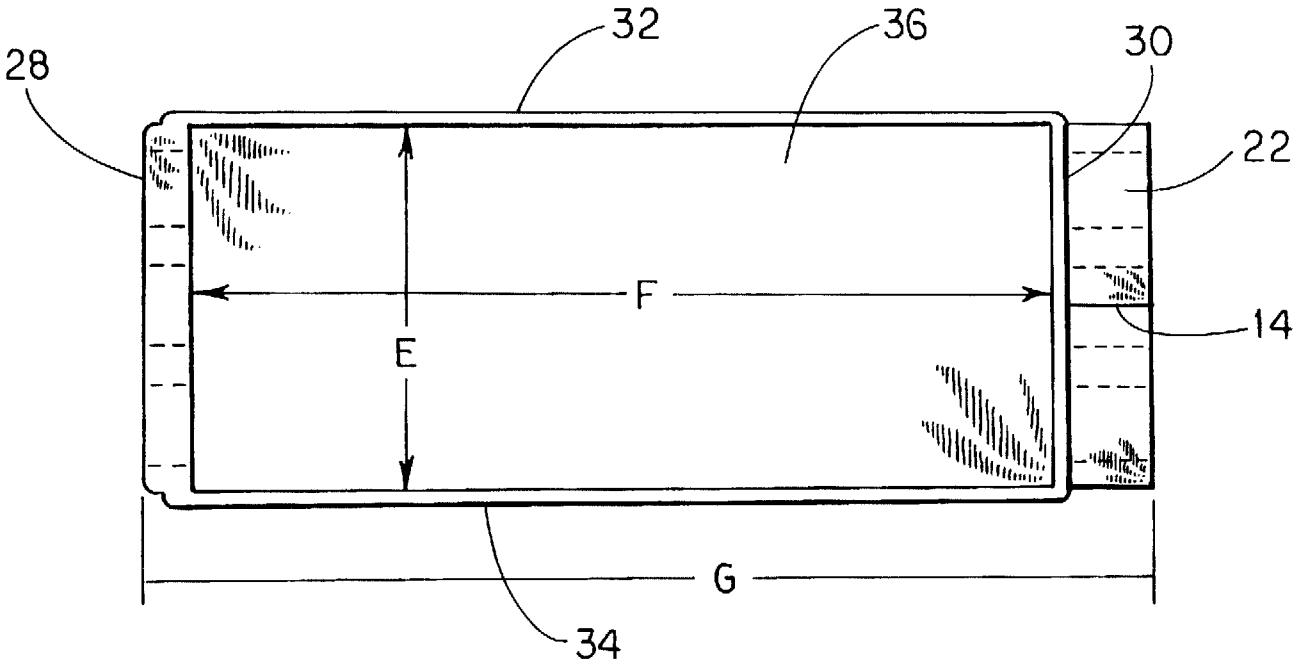
FIG. 5) Is a view of the gun rest if looking down at the top. It also shows inside diameters and overall length of the top.

Dimension E, or width of receptacle 38, as shown in FIG. 5, is 46 mm.

Dimension F, or length of receptacle 38, as shown in FIG. 5, is 112 mm.

Dimension G, or length from outside of loop 22 to top of front surface 28, is 132 mm.

Dimension H, or length of bottom 36 including bottom fold of loop 22, is 134 mm.

The article supports the weight of a weapon, in a substantially upright non-firing position, from a belt loop at the waist.

The article is made of camouflage material, and nylon thread which is soft, and will not damage the stock of a weapon.

The article is very flexible, lightweight, and compact for easy storage in small places.

I claim:

1. A gun rest for supporting a firearm in an upright non-firing position from a belt encircling the waist of a person, said gun rest comprising:

a flexible receptacle for releasably receiving a buttstock of a weapon, said flexible receptacle having a front wall, a back wall, a right side wall, a left side wall, and a bottom, said right and left side walls being wider than said front and back walls to form an elongate flexible rectangular cavity, said back wall, right side wall, and left side wall are substantially vertical, said bottom is substantially horizontal, and said front wall is angled rearwardly thereby causing said receptacle to conform to a typical tapered shape of a buttstock; and a flexible loop extending from said back wall of said flexible receptacle, said loop adapted for receiving a waist encircling belt;

whereby said flexible receptacle releasably receives said buttstock oriented substantially perpendicular to said belt.

2. The gun rest as recited in claim 1, wherein said gun rest is comprised of a first piece and a second piece of material sewn together to form said receptacle and said loop.

3. The gun rest as recited in claim 1, further comprising reinforcing stitching.

4. The gun rest as recited in claim 3, wherein said reinforcing stitching is comprised of nylon thread.

5. The gun rest as recited in claim 1, wherein said gun rest is formed of a flexible, lightweight camouflage cloth material and nylon thread.

6. The gun rest as recited in claim 5, wherein said gun rest can be rendered compact for storage.

7. A gun rest for supporting a firearm in an upright non-firing position from a belt encircling the waist of a person, said gun rest comprising:

a flexible, lightweight receptacle for releasably receiving a buttstock of a weapon, said receptacle having a front wall, a back wall, a right side wall, a left side wall and a bottom, said back wall, said right side wall and said left side wall are substantially vertical and said bottom is substantially horizontal, said front wall and said back wall are narrower than said right side wall and said left side wall to form an elongate flexible rectangular cavity, and said front wall is angled rearwardly thereby causing a said receptacle to conform to a typical tapered shape of a buttstock; and a loop affixed to said back wall of said flexible receptacle, said loop adapted for receiving a waist encircling belt;

whereby said flexible receptacle releasably receives said buttstock oriented substantially perpendicular to said belt.

* * * * *

UNITED STATES PATENT AND TRADEMARK OFFICE

CERTIFICATE OF CORRECTION

PATENT NO. : 5,765,732
DATED : June 16, 1998
INVENTOR(S) : Darrell Wayne Brandt

It is certified that error appears in the above-identified patent and that said Letters Patent is hereby corrected as shown below:

On the title page, item [76], delete "Ak." and insert --Ar.--.

Signed and Sealed this

Fifteenth Day of December, 1998

Bruce Lehman

*Attest:*

BRUCE LEHMAN

*Attesting Officer*

*Commissioner of Patents and Trademarks*